US006640591B1

(12) United States Patent
Haban

(10) Patent No.: US 6,640,591 B1
(45) Date of Patent: Nov. 4, 2003

(54) APPARATUS AND METHOD FOR PRODUCTION OF FABRICS

(76) Inventor: Eugene Haban, 6913-C Acco St., Montebello, CA (US) 90640

( * ) Notice: Subject to any disclaimer, the term of this patent is extended or adjusted under 35 U.S.C. 154(b) by 0 days.

(21) Appl. No.: 10/291,298

(22) Filed: Nov. 12, 2002

(51) Int. Cl.[7] ..... D04B 27/10
(52) U.S. Cl. ..... 66/210
(58) Field of Search ..... 66/125 R, 146, 66/126 R, 133

(56) References Cited

U.S. PATENT DOCUMENTS

| | | | | | |
|---|---|---|---|---|---|
| 3,781,532 | A | * | 12/1973 | Dorsman et al. | 66/125 R |
| 4,613,336 | A | | 9/1986 | Quinnen | 8/494 |
| 4,821,199 | A | * | 4/1989 | Kuhnert | 66/125 R |
| 5,152,158 | A | * | 10/1992 | Wirth | 66/212 |
| 5,176,010 | A | * | 1/1993 | Wirth et al. | 66/212 |
| 5,285,821 | A | * | 2/1994 | Fredriksson | 66/125 R |
| 5,369,966 | A | * | 12/1994 | Morita et al. | 66/132 R |
| 5,378,246 | A | | 1/1995 | Gurley | 8/625 |
| 5,524,461 | A | * | 6/1996 | Nielsen et al. | 66/210 |
| 5,611,822 | A | | 3/1997 | Gurley | 8/625 |
| 6,035,669 | A | | 3/2000 | Gutschmit | 66/157 |
| 6,170,301 | B1 | * | 1/2001 | Stoll et al. | 66/126 R |
| 6,199,787 | B1 | | 3/2001 | Jaffar et al. | 242/418.1 |
| 6,247,335 | B1 | | 6/2001 | Schaeberle et al. | 66/9 B |
| 6,386,003 | B1 | | 5/2002 | Wang | 66/136 |
| 6,439,488 | B1 | | 8/2002 | Hunter | 242/150 R |

* cited by examiner

*Primary Examiner*—Danny Worrell
(74) *Attorney, Agent, or Firm*—Erik M. Arnhem

(57) ABSTRACT

Using a control system, yarn ends unwound from at least one or more beams, small packages, or any or all combinations thereof may be directly fed to at least one or more knitting machines. The control system with its processing units in cooperation with various sensors control the rotation of at least one or more beams to allow the feedwheel units of circular or flat bed knitting machines to draw yarn therefrom. In addition, if small packages are used either alone or in combination with at least one or more beams, they should come from the same "batch" of yarn that were originally back wound together. This "batch" of small packages should be used and fed to circular or flat bed knitting machines together.

7 Claims, 5 Drawing Sheets

APPARATUS AND METHOD FOR PRODUCTION OF FABRICS

BACKGROUND OF THE INVENTION (1) Field of the Invention

The present invention relates to a system and a method for production of fabrics, and more specifically to textile machinery that can be directly fed threads or yarn wound on a beam.

(2) Description of the Related Art

In general, most textile machines that produce yarn wound it onto cones or small packages before it is further processed. For example, most fabrics with indigo dye are produced by yarn wound onto cones, dyed in indigo, and then wound on a beam (by a dye machinery), and then further processed through several steps to later be fed to knitting machines. The beam may be likened to a very large cotton reel, perhaps six feet long, having a large number of yarn threads (or ends) wound thereon in a generally parallel fashion. Of course, the yarns need not be dyed to be wound onto a beam. There are varieties of methods to produce indigo-dyed yarn, some of which are taught in U.S. Pat. Nos. 5,611,822 and 5,378,246, both to Gurley.

Regardless of whether a yarn is indigo-dyed or even dyed at all, most yarn wound onto a beam are however, unsuitable for use with certain knitting machines, including for example, both circular and flat bed knitting machines. The exceptions to this rule are the warp knitting machines, which can accept yarn directly from a beam.

The operation and use of warp knitting machines are different from both circular and the flat bed machines. In warp machines all components (feeders and needles) move synchronously and take in the same length of yarn ends from a beam simultaneously, creating uniform pattern fabrics. Although the synchronous movement of components allows yarn to be directly fed from a beam, it also limits the use of this machine to producing only certain types of fabrics. Hence, the warp machines are not as flexible and versatile as the circular knitting machines, and their use is limited.

The prior art circular or flat bed knitting machines cannot accept yarn fed from a beam because of the way they operate and therefore yarn must be fed to these machines by some other means. One known method is to use yarn wound onto individual cones or small packages, where it can later be fed from there to the knitting machine. In operation of these machines, needles having hooks at one end are moved in reciprocating fashion to engage yarns and to pull them into loops or various structures to form a knitted fabric. When circular or flat bed knitting machines proceed with knitting operations, yarn feeders (or guide feeders) feed the yarns continuously to the knitting needles. The needles then stitch or tuck the yarns to loops for forming the desired fabric. The feeders and the needles work independently. In fact, even the individual needles move independent of one another. Known positive feeding devices are sometimes used to help synchronize the movement of the needles with the yarn feeder operations. These devices help synchronize the speed with which all the individual yarn ends are pulled from cones with the operational movement (or pull) of each individual needle on the yarn. The positive feeding devices however, can only work with yarn fed directly from the cones or other small packages. They comprise of small rotating mechanisms, about three to four inches in diameter, and are moved by a belt system to "pull-in" the yarn.

The asynchronous movement of components within these machines makes them unsuitable for direct feeding of yarn from a beam. The reasons for this is because all individual yarn ends on a beam are uniformly wound and are let off (or unwound) uniformly. That is, the same yarn length for all yarn wound on a beam are uniformly let off for each degree of rotation of the beam regardless of the yarn length requirements of each individual feeder or needle in a knitting machine. In addition, a typical beam is about five feet in diameter, six feet in length, weighs hundreds of pounds, and has its own motor mechanism that rotates it independent of any other machine. This also makes it impossible for the prior art circular or flat bed knitting machine to "pull-in" yarn directly from a beam. Accordingly, the prior art circular or flat bed knitting machines must use yarn that was wound onto cones or other small packages.

The processing steps required to prepare these cones or the packages however, are tedious, very time consuming, labor intensive, and extremely costly. In addition, the quality of the yarn itself degrades after each of these processing steps, resulting in a poor quality knitted fabric. This is especially true for a dyed yarn in general and indigo-dyed yarns, in particular.

There are two main methods for winding yarns onto cones or packages, and they are taught by U.S. Pat. No. 4,613,336 to Quinnen and U.S. Pat. No. 6,199,787 to Jaffar et al. The entire disclosures of both of these patents are incorporated herein by reference. Quinnen moves each individual yarn end from a beam onto a plurality of cones. Jaffar et al transfers the individual yarn ends onto several skeins, and then back winds the yarn from each skein onto cones. A skein is a reel type structure that has one yarn end wound onto it. With both methods, the cones may then be manually placed onto creels for later use by circular or flat bed knitting machines. Creels are supporting devices that can hold several cones or small packages of yarn.

Several cones or skeins may be required to wind even a single yarn end from a beam because each beam may contain several thousand yarn ends, with each end approximately 50,000 to 60,000 yards. It will also take several skeins to back wind yarn onto a single cone.

As illustrated above, the steps taken by both methods are very involved and costly. In addition, these processes also reduce the quality of the dyed yarn due to abrasion. Abrasion is fundamental in the processing of most dyed yarns in general and indigo-dyed yarns in particular. Abrasion is the peeling or removal of dye surface material or dyestuff on a yarn. It occurs non-uniformly throughout the length of a dyed yarn with every step of yarn transfer. A dyed yarn wound on a cone may therefore have a darker color at its middle length and lighter at its two ends. When several cones having different degrees (or shades) of degraded dyed-yarn are used to knit fabrics, the final product produced may show undesired stripes or variations in color, sometimes known as barre lines. The transfer processes mentioned above also degrade the physical quality (e.g. texture, strength, etc.) of the yarn itself.

The cost associated with these processes are high because the yarn must be moved (or unwound) from a beam and then back wound onto cones (either directly or through skeins). The cones then must be manually placed onto creels, and the yarns on each cone hooked or connected physically to the knitting machines. The quality of the yarn also degrades with each transfer. These processes are also very labor intensive, requiring specialized personnel and equipment.

SUMMARY OF THE INVENTION

The present invention seeks to provide a system apparatus and methods for textile machines that can draw at least one yarn end (or thread) directly from at least one or more beams, reducing costs for specialized labor associated with yarn feeding processes.

The present invention further seeks to provide a system apparatus and methods for textile machines that draw at least one yarn end from at least one or more cones or small package structures to produce fabric with no barre lines.

The present invention also seeks to provide a system apparatus and methods for textile machines that draw at least one yarn end from at least one or more cones or small package structures and at least one or more beams simultaneously.

It is an object of the present invention to provide a system apparatus and methods that avoid abrasion problems associated with yarn transfers from beams or small packages to other small packages.

It is another object of the present invention to provide an appropriate method of yarn transfer from a beam to small packages, and from small packages to knitting machines in such a manner, that eliminates barre lines.

In keeping with the principles of the present invention, unique yarn feeding mechanism control systems and knitting machinery are presented which overcome the shortfalls of the prior art. The system comprises of at least one control unit having at least one central processing unit and sensory devices that enable synchronized feeding control of yarn from sources (beams, small packages, etc.) with the intake thereof of a plurality of knitting machines.

One or more control units output signals from one or more central processing units to beam rotating devices to control beam rotation and yarn feed to one or more knitting machine. The output signals are based on input signals from a variety of sensory systems located throughout the entire system. The variations in radius of each outer layer yarn end wound around beams, rotational speed of beams, movement and direction of compensators, and drive mechanism of knitting machines are all accounted for and synchronized by the control system to enable proper direct yarn feed from a plurality of sources to a plurality of knitting machines.

These and other objects, features, aspects, and advantages of the invention will be apparent to those skilled in the art from the following detailed description of preferred non-limiting embodiments, taken together with the drawings and the claims that follow.

BRIEF DESCRIPTION OF THE DRAWINGS

It is to be understood that the drawings are to be used for the purposes of illustration only and not as a definition of the limits of the invention.

Referring to the drawings in which like reference numbers present corresponding parts throughout.

DETAILED DESCRIPTION OF THE INVENTION

Figure 1:
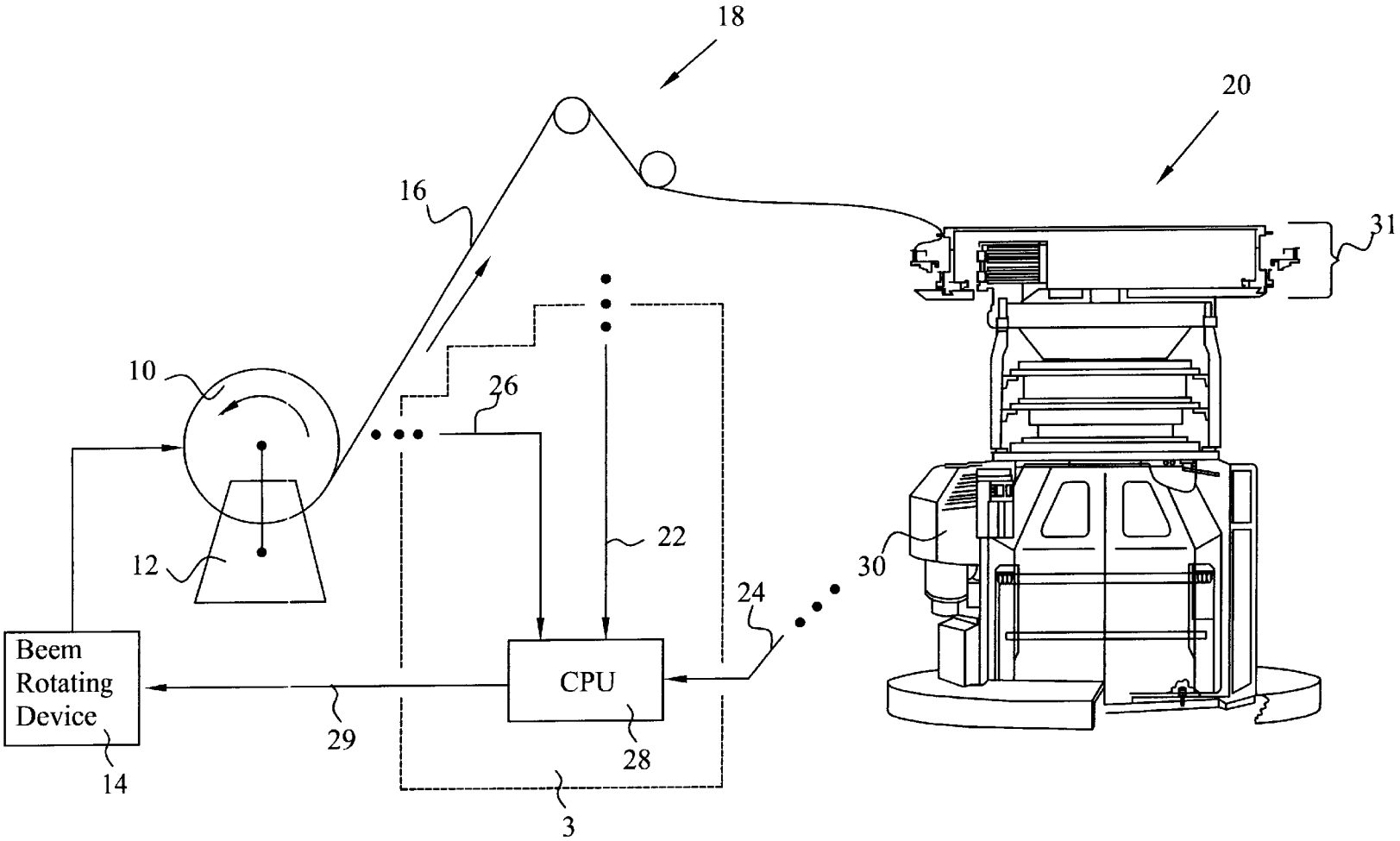
FIG. 1 illustrates a general view of the system of the present invention.

A general overview of the present invention is shown in FIG. 1, which includes a beam 10 on a base unit 12 rotated by a beam rotating device 14 such as for example, a motor to let off (or unwind) a plurality of yarn ends 16. Although a single line is shown for yarn ends 16, it should be understood that the line represents at least one or more yarn ends. Ends 16 are fed to the feedwheel units 31 of a circular or flat bed knitting machine 20 through a set of compensators 18. Although only two feedwheel units 31 are illustrated, it should be understood that each machine might comprise of several such units. The threads or yarn ends illustrated may be of any material suitable for use with a knitting machine.

FIG. 1 further illustrates a control system 3 comprised of one or more sensory and central processing units 28, which output a signal 29 for control of beam rotating device 14. The control system 3 may be either centrally located or spread throughout the system. Variations in radius of each outer layer yarn end 16 wound around beam 10, rotational speed of beam 10, movement and direction of compensators 18, and drive mechanism 30 of machine 20 are all accounted for and synchronized by the control system 3. An input signal 26 to CPU 28 is output from at least one periphery sensor system 60 that detects variations in the radius of the outer layer yarn end wound around beam 10. Another input signal 22 to CPU 28 is the output from at least one compensator sensor system 78 that detects the movement and direction of compensators 18. A third input signal 24 to CPU 28 is output from at least one sensing unit that detects the movement of mechanism 30 of knitting machine 20. All signals transmitted or received may be of any form, including but not limited to, for example, digital, analog, optical, IR, RF, wireless, or any or all known combinations. Sensor systems illustrated may be of any type appropriate for the intended use and environment. If a sensor is used for detection of motion for example, any type of motion sensor appropriate for the intended environment may be used. The motion sensor system may include, but not be limited to, for example, optical, magnetic, mechanical, electrical or any or all known combinations.

Figure 2:
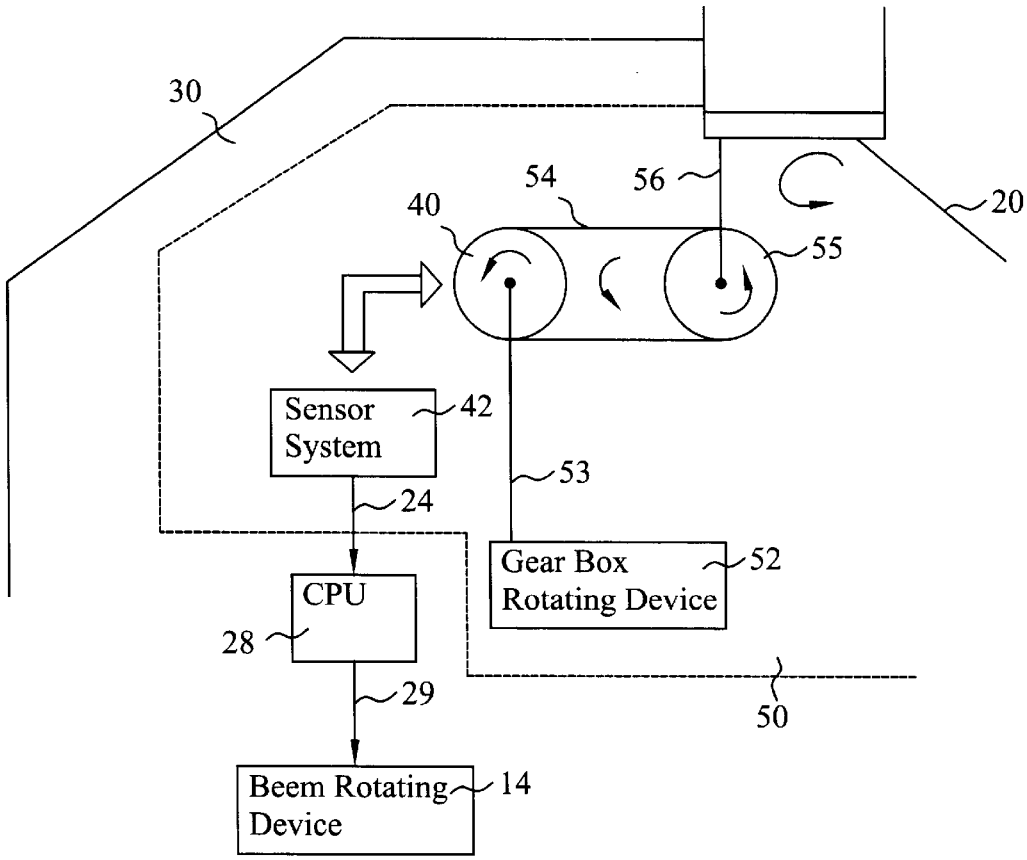
FIG. 2 illustrates the details of the drive mechanism of a textile machine, in accordance with the present invention.

Variations in the movement of drive mechanism 30 must be accounted for and synchronized with the rest of the system. If machine 20 accelerates or decelerates, beam 10 must also do the same. This synchronization should be exact. The details of drive mechanism 30 of the present invention are shown in FIG. 2. The drive mechanism 30 comprises a gearbox shaft 50 that includes a gearbox rotating device 52 connected to a disc or plate 40 through second shaft 53. As device 52 rotates, it also turns the plate 40 to rotate a gear shaft 54. The gear shaft 54 then turns a second disc 55, which drives third shaft 56 to rotate the circular knitting machine 20. As an example, in general, for a typical knitting machine approximately 31.2 revolutions (or turns) of plate 40 are equal to one full revolution of the circular knitting machine 20. The smaller the diameter of disc 40, the more accurately each degree of its rotation will reflect or mirror the degrees of rotation of the knitting machine 20. The yarn feed rate per revolution of knitting machine 20 can be set, and will usually remain constant thereafter. To illustrate, a typical circular knitting machine may be set to draw about 500 inches of yarn per turn of the machine 20. The speed by which this 500 inches is drawn however, may vary depending on a variety of reasons, including variations in stitch length for different fabric structures. Therefore, the feeding of yarn to knitting machines measured in length may be constant with respect to the turn of the machine, but will be proportional to the speed of the turn based on time. Sensor system 42 appropriately located in relations to the plate 40 is used to detect variations in this rotational speed of the machine 20. Upon detection of any motion, sensor 42 transmits a signal 24 for input to the CPU 28. The signal 24 is used by CPU 28 to adjust and synchronize the rotation of beam 10 commensurate with the rotational speed of the circular knitting machine 20. The CPU 28, based on the detected instantaneous rotational speed of the knitting machine 20, and other factors to be mentioned later, determines the amount of yarn to be let off beam 10 and fed to the circular knitting machine 20. In addition, the CPU 28 continuously calculates the exact amount (in length or in weight) of yarn drawn from beam 10 and fed to the knitting machine 20.

Sensor system 42 may comprise of any sensor or sensors appropriate for the intended use and environment, including, but not limited to, for example, at least one or more optical, mechanical, electrical, magnetic, or motion, or any or all known combinations. The output signal 24 may be of any form appropriate for the intended use, including, but not limited to, for example, digital, analog, optical, IR, RF, timing signals, or wireless, or any or all known combinations.

Figure 3:
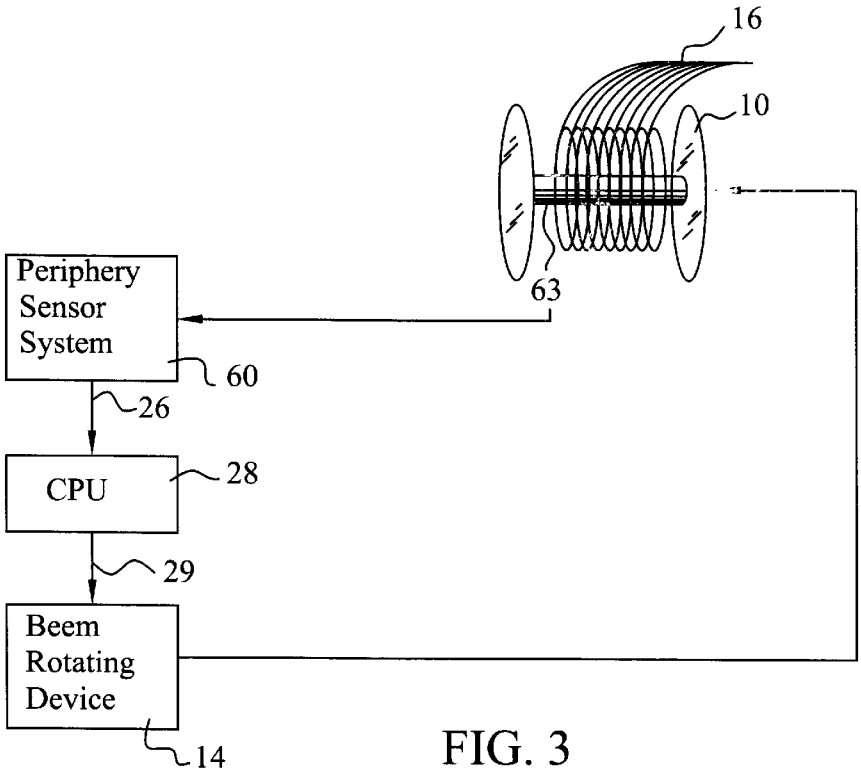
FIG. 3 is a schematic illustration of periphery sensor system in accordance with the present invention.

FIG. 3 illustrates a periphery sensor system 60 used for detection of the radius for the outer layer yarn ends 16 wound on beam 10. As beam 10 rotates, it will let off (or unwind) yarn, and as a result the radius of the outer layer yarn wound around beam 10 will decrease. Assuming a constant rotational speed, after every full revolution of beam 10, the length of each yarn end 16 that is unwound will also continuously decrease. In other words, continuously decreasing lengths of yarn are unwound per revolution of beam 10. This simple relationship may be illustrated by the following well known formula.

$$2\pi r = \text{circumference}$$

Where the Greek symbol $\pi$ represents a well known constant equal to approximately 3.1415, the letter "r" represents the radius of the outer layer yarn end wound around beam 10, and the circumference represents its length. As the outer layer yarn end is unwound, the radius "r" of the total yarn wound around the beam 10 becomes smaller, and consequently, the circumference or the length of the next outer layer yarn still wound around beam 10 reduces. Continuous variations in radius and length of yarn unwound per revolution of beam 10 must therefore be constantly accounted for and synchronized with other components to avoid yarn breakage. The periphery sensor system 60 is used to provide CPU 28 information about yarn wound around beam 10, which may include the radius of the cylinder 63 of beam 10 and continuous radial measurements of the outer layer yarn ends 16. The CPU 28 uses these parameters to continuously adjust the rotational speed of beam rotating device 14 commensurate with variations in the radius of outer layer yarn ends 16, per revolution of beam 10. Hence, as the radius of the outer layer yarn end 16 wound on a beam 10 is decreased, the rotational speed of beam 10 is increased to compensate for any decrease in length of yarn being let off due to reductions in the circumference of the yarn wound around the beam 10.

The periphery sensor system 60 may comprise of any sensor or sensors appropriate for the intended use and environment, including, but not limited to, for example, at least one or more optical, mechanical, electrical, magnetic, or motion, or any or all known combinations. The output signal 26 may be of any form appropriate for the intended use, including, but not limited to, for example, digital, analog, optical, IR, RF, timing signals, or wireless, or any or all known combinations.

Another method for detection and control of yarn being let off beam 10 is to use a well known algorithm (used for warp knitting machines) for the CPU that calculates and controls the rotational speed of the beam 10 without the use of the sensor 60. The algorithm is comprised of open loop programs that control, calculate and store in memory information about the yarn wound around the beam and the consumption thereof by the knitting machine. Program A determines the amount of yarn being fed to the knitting machine, and is calculated by multiplying a constant K times the outer diameter or outside circumference OD of the yarn wound around the beam, and is automatically updated during knitting by a second program B.

$$\text{Program } A = OD \times K \tag{1}$$

Program B stores information regarding the consumption of the yarn, and at the proper time updates the first program to increase the rate at which the beam turns.

$$\text{Program } B = \frac{Y \times M}{(OD)^2 - (ID)^2} \tag{2}$$

Program B is calculated by the yardage Y of yarn wound around the beam multiplied by a constant M, the result of which is divided by the Outside Diameter squared $(OD)^2$ minus the barrel diameter (or the Inside Diameter) squared $(ID)^2$. The outside diameter OD is the diameter of the yarn wound around the beam at the given yardage Y. Both programming constants K and M relate to the gear reduction on the beam drive plate, and will vary depending on different gear ratios. Typical constant values for K and M may be 88.082 and 89.09, respectively, for a gear ratio of 34.24:1.

Tension in yarn ends 16 may be caused by a variety of reasons, including variations in the rotational speed of beam 10 or the knitting machinery 20. For example, there are instances where the knitting machine 20 is required to be shut down, restarted, or have its speed varied. In particular, any acceleration or deceleration of the knitting machine will effect its yarn in-take, causing variations in the tension of yarn ends. An excess tension beyond a certain level may cause yarn breakage; a decrease in tension may effect the operations of the feedwheel units 31 of the knitting machine 20. The momentum generated due to beam's size, weight, and rotational speed would make it difficult and costly to control its rotation to compensate for every small and sudden variation in yarn tension.

Figure 4:
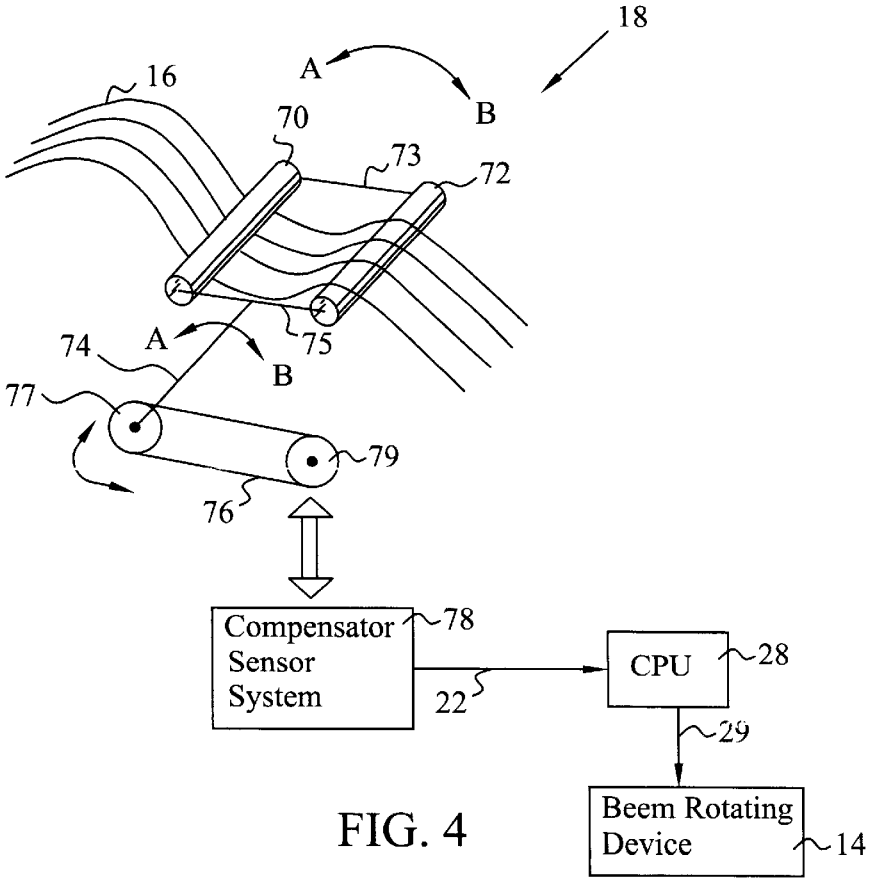
FIG. 4 is a schematic illustration of compensator sensor system of the present invention.

Compensators 18 illustrated in FIG. 4 are used to provide a cost effect method to balance and maintain a constant tension on all yarn ends 16 fed from beam 10 to knitting machine 20. The compensators 18 "trim" out or fine tune any excess tension or looseness on yarn ends 16 by moving in one of directions A or B as illustrated in FIG. 4. Their movement in either direction balances out any tension on yarn ends 16. Their quick action provides enough time for the entire system to overcome the rotational momentum of beam 10 to change it, before any yarn breakage.

In general, compensators 18 are comprised of two cylindrical bars 70 and 72 connected to each other by couplers 73 and 75. A shaft unit 74 connects the second coupler 75 to a first rotator disc 77. This disc is further coupled to a second rotator disc 79 through a chain (or belt) 76. The directional movement of compensators 18 depends on the increase or the decrease in the tension of the yarn ends 16. To illustrate, if tension in yarn ends increase, the compensator cylinder bars 70, 72, and all other components connected thereto may for example move towards direction B. This quick action relieves tension in the yarns 16 before their breakage.

Any movement of compensators 18 is detected by a compensator sensor system 78, which transmits output signals 22 to CPU 28. CPU 28 uses these signals to control the beam rotating device 14 to vary the rotational speed of the beam 10. Compensators 18 allow beam 10 enough time to overcome its own momentum and react to the output signal 29 of CPU 28 before any yarn breakage. The output signal 29 enables commensurate acceleration or deceleration of beam 10, allowing for an appropriate length of yarn to be output from the beam. Variations in rotational speed of beam 10 therefore, help compensate any unwanted variations in tension on the yarn ends 16 before the yarns or the movement of compensators 18 themselves reaches their maximum threshold levels.

Compensator sensor system 78 may comprise of any sensor or sensors appropriate for the intended use and environment, including, but not limited to, for example, at least one or more sensors such as optical, mechanical, electrical, magnetic, or motion, or any or all known combinations. The output signal 22 may be of any form appropriate for the intended use, including but not limited to, for example, digital, analog, optical, IR, RF, timing signals, or wireless, or any or all known combinations.

Figure 5:
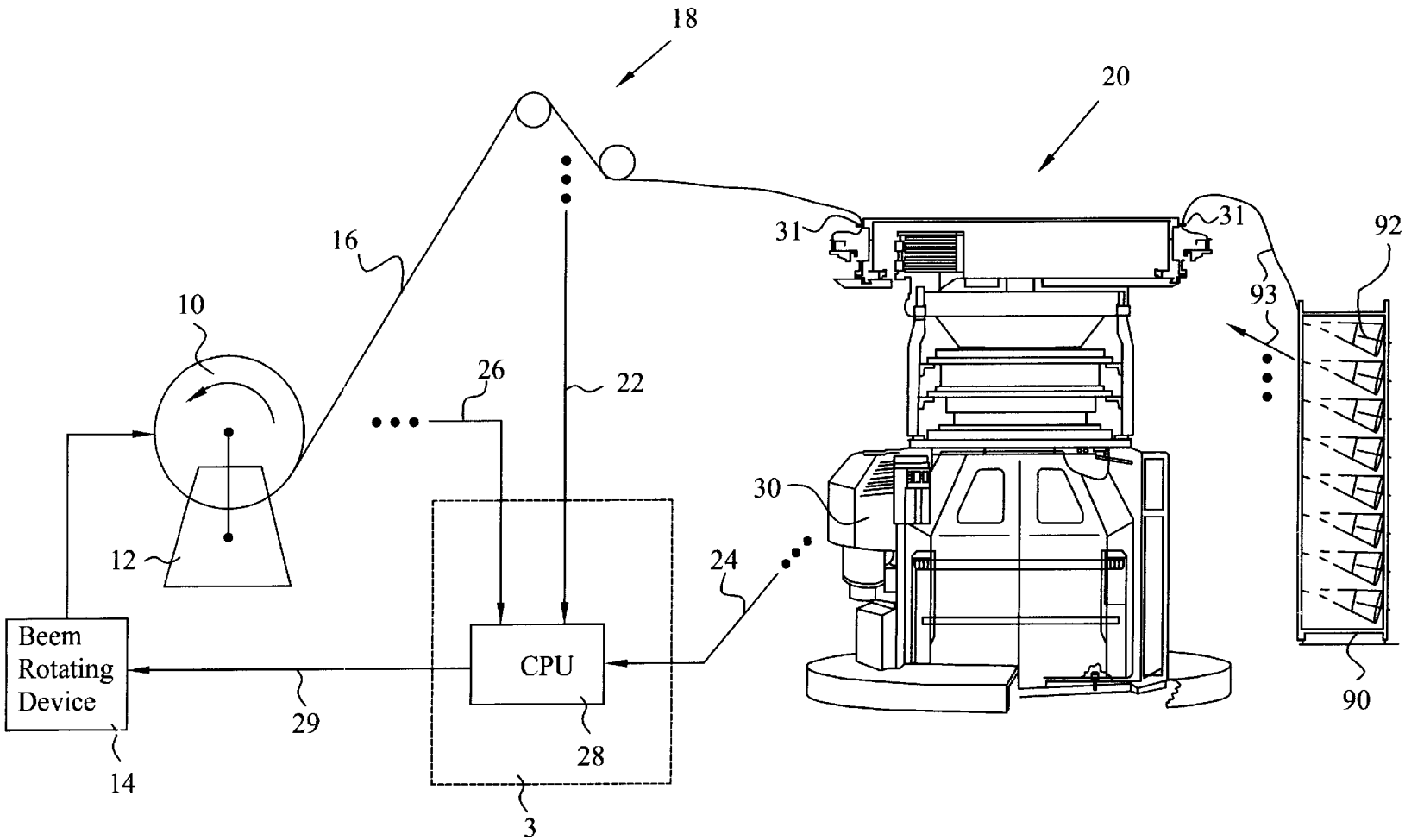
FIG. 5 illustrates combination feeding of yarn from a beam and small packages in accordance with the present invention.

FIG. 5 illustrates another embodiment of the present invention where yarn 93 wound on plurality of cones or small packages 92 placed on creel 90 are used in combination with beam 10 to feed the yam ends 16 and 93 to the knitting machine 20 through feedwheel units 31. The rest of the components illustrated are identical to that of FIG. 1, and its description. This combination may be used if a variety of different colors dyed yarns is required to knit a fabric. Regardless of the number of small packages of yarns or beams used, the number of yarn ends fed must equal to the number of feedwheel units on the knitting machine. To illustrate, if a machine comprises of 120 feedwheel units 31, then any combination of beams or small packaged yarn can feed at most 120 yarn ends to the machine 20.

Variations in shades of a dyed-yarn wound on small packages due to dying processes must be considered when using them to feed yarn to a knitting machine. Dyed yarn ends may have infinitesimal variations in their shades throughout their length as they are wound onto a beam from dye machines. This variation is gradual and uniform from one end of the yarn to the other because yarns that are dyed next to each other will most likely have the same shade of dye, and are wound around beam 10 together. Yarn ends wound on a beam may therefore uniformly have a different shade dye on their top wound periphery (or outside) layer of winding compared to the bottom or inside layer (near the frame of the beam). When yarn ends are moved (or unwound) from the beam and back wound onto several small packages, each package may contain yarn from a top, middle, or end, or a combination thereof of yarn unwound from the beam. This results in each package having different shades of dyed-yarn. When yarn on small packages having different shades of dye are fed to knitting machines, the resulting knitted fabric will show unwanted barre lines.

All individual yarn ends on a beam are uniformly wound and are let off (or unwound) uniformly as the beam is rotated. Accordingly, to avoid undesired barre lines, small packages that are back wound together should also be fed to the machines together. For example, to make and use 60 cones from 60 yarn ends wound on a beam 10, it would be best to transfer the 60 yarn ends from a beam onto 60 cones in "one-shut" until the cones are "filled." Then use all the cones in this first "batch" to feed a knitting machine to produce a fabric. The process should be repeated unit all yarn ends are transferred from a beam to small packages, keeping an account of all packages and the "batch" that they belong. Of course, mixing the batches of small packaged yarns will result in knitted fabrics with barre lines.

Figure 6:
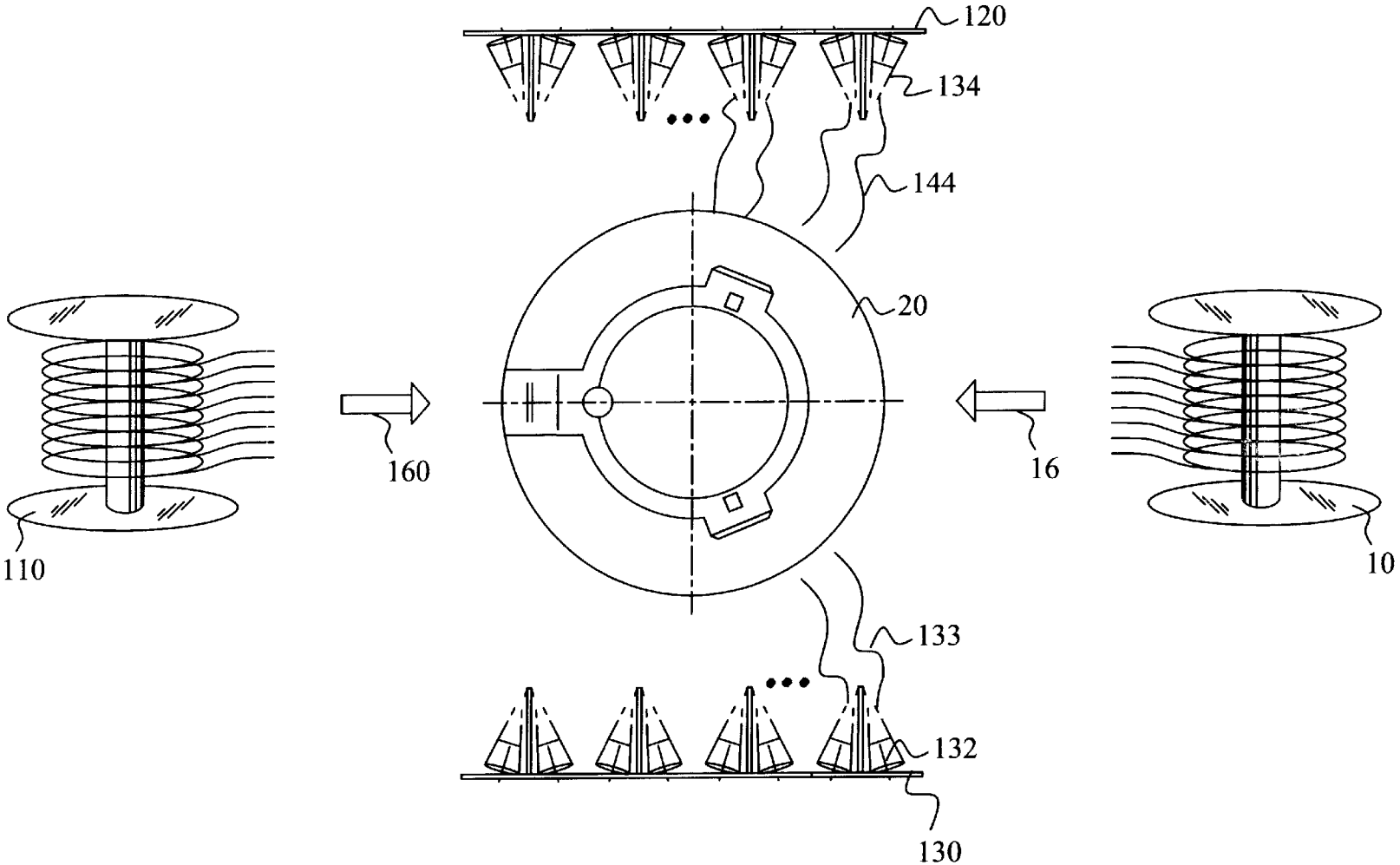
FIG. 6 illustrates combination of feeding of yarn from a plurality of beams and small packages in accordance with the present invention.

FIG. 6 illustrates a further embodiment where a plurality of beams 10, 110, and creels 130, 120 with small packages (or cones) 132, 134 thereon are used to feed yarn ends to a knitting machine 20. Although the illustration shows the use of two beams 10, 110 with two creels 120, 130, filled with small packaged yarn, any number and combination may be used with the system. The various control systems 3, including but not limited to, for example, at least one or more compensators, sensors, CPUs or any or all combinations thereof may be used with this embodiment as well, but are not shown for clarity. In addition, the small packages used should be prepared according to the description given above with respect to FIG. 5, before yarn is fed from these packages to the knitting machine.

While illustrative embodiments of the invention have been described, numerous variations and alternative embodiments will occur to those skilled in the art. For example, it may be possible to use only a single CPU for a system that uses at least one or more beams, creels, knitting machines or any or all combinations thereof. The number, location, and type of sensors used may also be varied. Transmission of all signals throughout the system may also be of any known type, including but not limited to, for example, digital, analog, wireless, optical, IR, RF, or any or all known combinations. Further more, the type of yarn used in the system is only limited to types recommended by manufacturer of knitting machines. Hence, the type (or material) of yarn used may include, but not be limited to, for example, cotton, nylon, kevlar, polyester, poly/cotton, wool, various metals or alloys, or any or all combinations thereof. In addition, although only a single circular knitting machine is illustrated, a plurality of such units, including flat bed knitting machines or any or all combinations thereof may also be used. Such variations and alternate embodiments are contemplated, and can be made without departing from the spirit and scope of the invention as defined in the appended claims.

I claim:

1. An apparatus, comprising:

at least one circular knitting machine;

at least one beam having a plurality of yarn ends wound thereon for supply of said yarn ends to said at least one circular knitting machine;

a control system for continuously synchronizing the operations of said at least one beam with intake of yarn by said at least one circular knitting machine for proper supply of said yarn ends from said at least one beam to said at least one circular knitting machine;

said control system comprising at least one central processing unit;

at least one rotational sensor system that detects a movement of a mechanism of said at least one circular knitting machine and transmits a first input signal to said at least one processing unit;

at least one periphery sensor system that detects variations in a radius of an outer layer of said yarn ends wound around said at least one beam and transmits a second input signal to said at least one central processing unit and;

at least one compensator sensor system that detects movement and direction of at least one compensator and transmits a third input signal to said at least one central processing unit;

said at least one central processing unit transmitting an output signal for continuous control of at least one beam rotating device to control a rotational speed of said at least one beam based on said first, second, and third input signals to synchronize said rotational speed of said beam with intake of yarn by said at least one circular knitting machine.

2. The apparatus of claim 1, further comprising:

at least one small package having yarn wound thereon for supply of said yarn to said at least one circular knitting machine simultaneously together with said yarn ends from said at least one beam.

3. The apparatus of claim 2, wherein said at least one small package has yarn from a same batch where a plurality of said at least one small packages were made simultaneously.

4. An apparatus, comprising:

at least one circular knitting machine;

at least one beam having a plurality of yarn ends wound thereon for supply of said yarn ends to said at least one circular knitting machine;

a control system for continuously synchronizing the operations of said at least one beam with intake of yarn by said at least one circular knitting machine for proper supply of said yarn ends from said at least one beam to said at least one circular knitting machine;

said control system comprising at least one central processing unit having open loop programs that control, calculate and store in said central processing unit information about said yarn ends and a consumption thereof by said at least one circular knitting machine;

at least one rotational sensor system that detects a rotation of a mechanism of said at least one circular knitting machine and transmits a first input signal to said at least one processing unit and;

at least one compensator sensor system that detects movement and direction of at least one compensator and transmits a second input signal to said at least one central processing unit;

said at least one central processing unit transmitting an output signal for continuous control of at least one beam rotating device to control a rotational speed of said beam based on said first and second input signals from said open loop programs to synchronize said rotational speed of said beam with intake of yam by said at least one circular knitting machine.

5. The apparatus of claim 4, wherein said open loop programs comprise of a first program to determine an amount of said yarn being fed to said at least one knitting machine, and a second program that stores information regarding a consumption of said yarn and at a proper time updating said first program to adjust a rate at which said at least one beam rotates.

6. The apparatus of claim 4, further comprising:

at least one small package having yarn wound thereon for supply of said yarn to said at least one circular knitting machine simultaneously together with said yarn ends from said at least one beam.

7. The apparatus of claim 6, wherein said at least one small package has yarn from a same batch where a plurality of said at least one small packages were made simultaneously.

* * * * *